US007111391B2

(12) United States Patent
McAdoo et al.

(10) Patent No.: US 7,111,391 B2
(45) Date of Patent: Sep. 26, 2006

(54) METHOD AND APPARATUS FOR LIFTING A TRUSS FROM A TRUSS ASSEMBLY TABLE

(75) Inventors: David L. McAdoo, Alvarado, TX (US); Kenneth T. George, Irving, TX (US)

(73) Assignee: Aldine Engineered Products, Inc., Pompano Beach, FL (US)

( * ) Notice: Subject to any disclaimer, the term of this patent is extended or adjusted under 35 U.S.C. 154(b) by 163 days.

(21) Appl. No.: 10/958,318

(22) Filed: Oct. 5, 2004

(65) Prior Publication Data

US 2006/0070235 A1 Apr. 6, 2006

(51) Int. Cl.

| | |
|---|---|
| ***B23P 19/00*** | (2006.01) |
| ***B23P 21/00*** | (2006.01) |
| ***B23P 11/00*** | (2006.01) |
| ***B23P 15/12*** | (2006.01) |
| ***B21D 39/03*** | (2006.01) |
| ***B21D 47/00*** | (2006.01) |
| ***B23K 23/00*** | (2006.01) |

(52) U.S. Cl. ..... 29/822; 29/772; 29/787; 29/429; 29/281.3; 29/897.31; 29/897.312; 29/798; 269/13

(58) Field of Classification Search ..... 29/772, 29/787, 429, 430, 822–824, 795, 281.3, 897.31, 29/897.312, 798, 281.1, 381.5, 432–432.2; 269/910, 13, 14; 227/148, 154, 99; 414/790, 414/790.1

See application file for complete search history.

(56) References Cited

U.S. PATENT DOCUMENTS 3,255,943 A 6/1966 Sanford
4,943,038 A * 7/1990 Harnden ..... 269/37
5,092,028 A * 3/1992 Harnden ..... 29/709
5,170,558 A * 12/1992 Hubbard ..... 29/897.31
5,355,575 A * 10/1994 Self ..... 29/430
6,560,858 B1 5/2003 McAdoo

* cited by examiner

*Primary Examiner*—David P. Bryant
*Assistant Examiner*—Christopher M. Koehler
(74) *Attorney, Agent, or Firm*—Crutsinger & Booth, LLC

(57) ABSTRACT

Apparatus and methods for moving a truss assembly from a truss assembly table work surface are presented having lift out rails movable between a recessed position beneath the work surface and a raised position above the work surface. A support element assembly is movably mounted to each lift out rail and has at least one support surface for supporting a truss assembly when the lift out rail is in the recessed position. The support element assembly is movable between an up position and a down position. In the up position the support surface is flush with the work surface of the truss table, the support element assembly in the up position when the lift out rail is in the recessed position. In the down position the support surface does not interfere with a truss assembly sliding on the slide mechanism of the lift out rail, the support element assembly in the down position when the lift out rail is in the raised position. The lift out rails can be inclined when in the raised position and can be inclined sufficiently to cause a truss on the rails to slide down due to gravity alone. The slide mechanism on each lift out rail has an upper surface which may be flush with the table work surface when the lift out rail is in the recessed position. The slide mechanism in one embodiment is a slide rod.

18 Claims, 7 Drawing Sheets

METHOD AND APPARATUS FOR LIFTING A TRUSS FROM A TRUSS ASSEMBLY TABLE

TECHNICAL FIELD

The present invention relates to an apparatus and method for manufacturing prefabricated wooden trusses. More particularly, the invention relates to an apparatus and method for moving an assembled truss off the truss table surface.

BACKGROUND OF THE INVENTION

Roof trusses are typically assembled on truss assembly tables having a work surface interrupted by various slots or gaps. Some of these gaps are for use with adjustable jigging assemblies and some are to allow space for lift out assemblies to lift the truss from the table and away from the table. The slots for the lift out assemblies tend to be large, often three inches or wider, and can create problems with the assembly of the truss. Connector plates, placed on the bottom side of the truss and abutting the table work surface may fall into or tilt into the gaps. Other connector plates may remain in position but not be fully supported by the work surface because of the gaps. In such instances, when a gantry press is rolled over the truss assembly, the connector plates are not properly pressed into the wooden truss members. For example, the connector plates may not "bite" into the members enough to remain in place during transfer of the truss assembly from the table to another material handling device. This is especially true in roof truss assembly devices where the system is not designed to completely press the connector plates into the truss members. Typically in roof truss construction the connector plates are only partially pressed into the truss assembly at the truss assembly table. Once the truss assembly is set in position by the partially embedded plates, the truss is transferred to another press, such as a finish roller press, to complete the embedding process.

Conventionally, truss assembly tables employ mechanical lift out assemblies having rollers that vertically lift the assembled truss off of the work surface. The truss is then manually pulled or pushed along the rollers toward another material handling device such as a conveyor. Some lift out assemblies are movable to a sloped raised position so that gravity moves or aids in the movement of the truss. The lift out assemblies use skate rollers or other wheels mounted on the lift out rails to ease sliding of the truss from the lift out assembly rails to another material handling device. These skate wheels may be fragile, however, and can be damaged requiring maintenance and replacement.

It would be desirable to provide a system which reduces or eliminates the problems presented by the lift out assembly gaps and which eliminates the use of fragile wheels mounted on lift out assemblies.

SUMMARY OF THE INVENTION

Apparatus and methods for moving a truss assembly from a truss assembly table work surface are presented having lift out rails movable between a recessed position beneath the work surface and a raised position above the work surface. A support element assembly is movably mounted to each lift out rail and has at least one support surface for supporting a truss assembly when the lift out rail is in the recessed position. The support element assembly is movable between an up position and a down position. In the up position the support surface is flush with the work surface of the truss table, the support element assembly in the up position when the lift out rail is in the recessed position. In the down position the support surface does not interfere with a truss assembly sliding on the slide mechanism of the lift out rail, the support element assembly in the down position when the lift out rail is in the raised position.

The lift out rails can be inclined when in the raised position and can be inclined sufficiently to cause a truss on the rails to slide down due to gravity alone. The slide mechanism on each lift out rail has an upper surface which may be flush with the table work surface when the lift out rail is in the recessed position. The slide mechanism in one embodiment is a slide rod. Preferably the slide rod is non-corrosive, such as chrome or stainless steel.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

The accompanying drawings are incorporated into and form a part of the specification to provide illustrative examples of the present invention and to explain the principles of the invention. The drawings are only for purposes of illustrating preferred and alternate embodiments of how the invention can be made and used. The drawings are not to be construed as limiting the invention to only the illustrated and described examples. Various advantages and features of the present invention will be apparent from a consideration of the accompanying drawings in which.

DETAILED DESCRIPTION OF PREFERRED EMBODIMENTS

Figure 1:
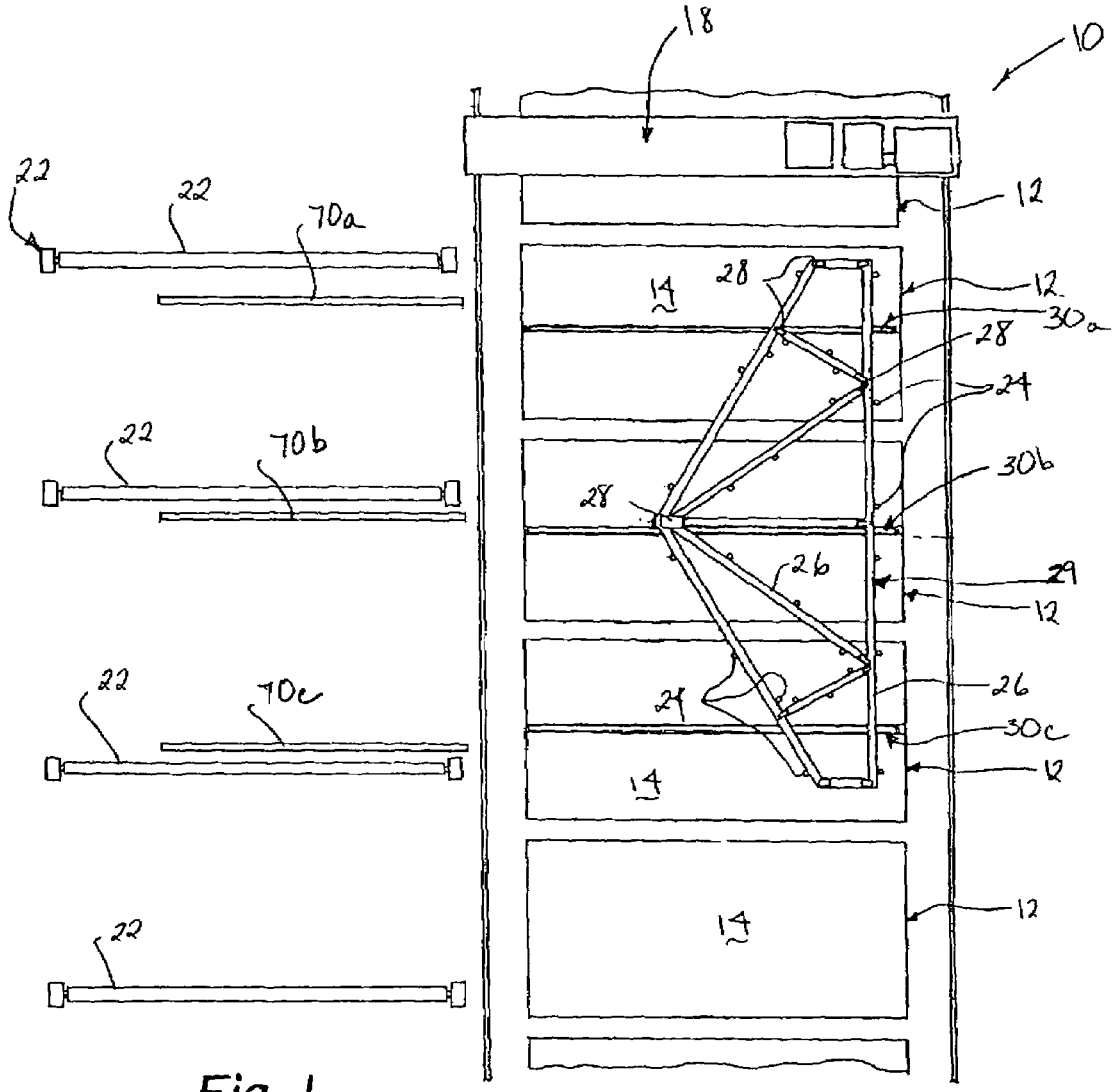
FIG. 1 is a top plan view of a truss assembly table and a conveyor for a truss manufacturing system, wherein the system includes lift out assemblies that are recessed beneath the work surface of the truss table and that can be used for mechanically lifting and moving an assembled truss from the truss table.

Referring first to FIG. 1, a top plan view of a truss assembly table and a conveyor for a truss manufacturing system according to the invention is shown. The system, generally referred to by the reference numeral 10, includes a conventional truss assembly table 12, which can further comprise a plurality of tables 12, defining an upper work surface 14 thereacross. A gantry press 18 is preferably mounted for movement along tracks that are positioned on either side of the truss assembly table 12, either on the ground or mounted on the table. The gantry press will not be described in detail herein and is well known in the art. Presses are described in detail in, for example, U.S. Pat. No. 6,612,230 to McAdoo, U.S. Pat. No. 5,933,957 to Haase, U.S. Pat. No. 5,211,108 to Gore and others, which are incorporated herein by reference for all purposes. A conveyor, which is defined by a plurality of rollers such as rollers 22, is positioned adjacent one of the sides of the truss assembly table 12. The conveyor may be of types known in the art. Alternately, other apparatus, such as a stacking or other materials handling device may be located adjacent the side of the table 12.

A plurality of jig stops 24 are positioned on the table. As is well known to those skilled in the art, the jig stops are individually adjustable to be positioned on the work surface 14 of the truss assembly table 12 to guide the assembly of various wooden members 26 for a truss 29. Connector plates 28 are tacked into position at the junctures of the wooden members 26, and the plates 28 are then set into place by passing the gantry press over the work surface of the truss assembly table 12.

According to the invention, at least two spaced-apart sloping liftouts, such as sloping liftouts 30*a–c*, are recessed beneath the work surface of the truss table and are used for mechanically lifting and moving an assembled truss 29 from the work surface 14 of the truss table 12 and away from the table 12. Where desired, movable receiving arms 70*a–c* may be used in conjunction with the lift out assemblies 30 to aid in moving the truss assembly.

Figure 2:
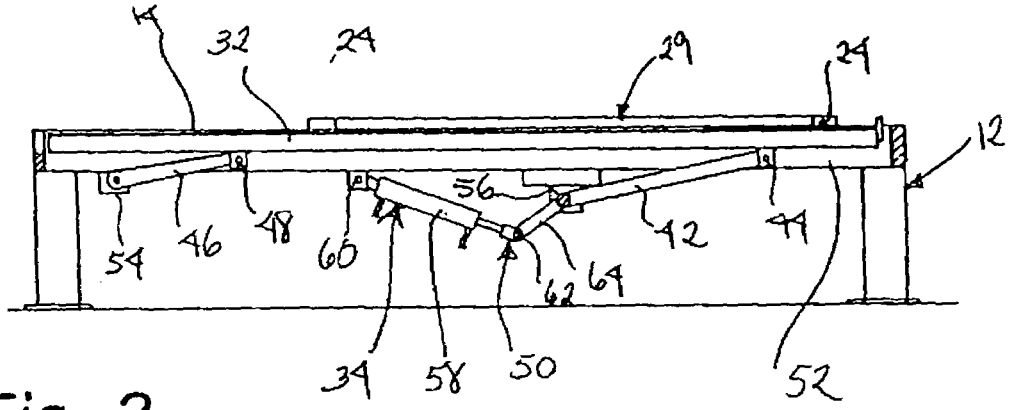
FIG. 2 a side elevation view of a truss assembly table showing the lift out assemblies in the recessed position.
Figure 3:
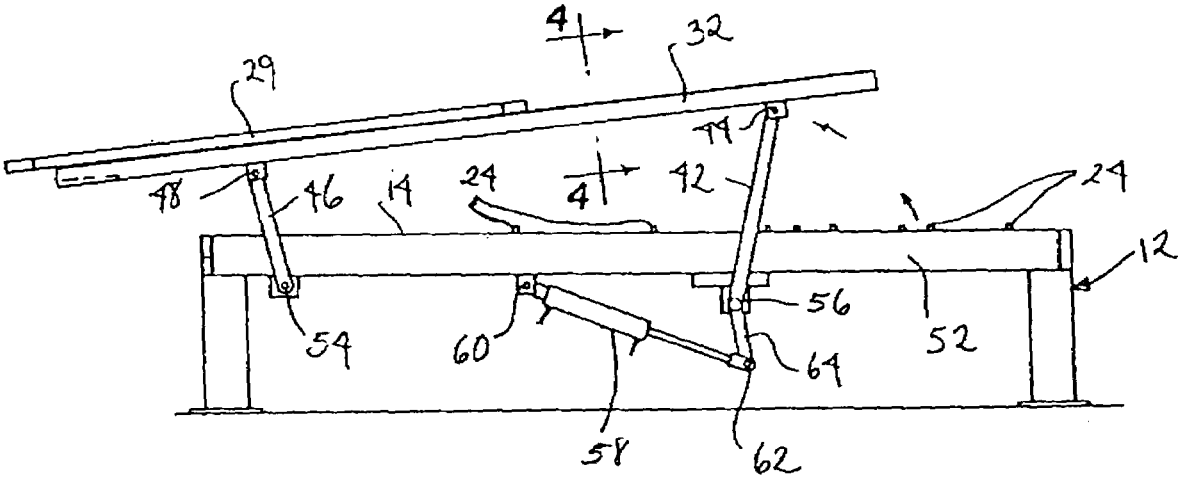
FIG. 3 is a side elevation view of a truss assembly table similar to that of FIG. 2 but showing the lift out assemblies in a raised position, whereby an assembled truss is lifted off the work surface of the table.

Referring now to FIGS. 2 and 3 of the drawing, each of the sloping lift outs 30*a*–30*c* includes a lift out rail 32 and a lift out rail translating assembly 34. Each of the liftout rail translating assemblies 34 is for moving one of the lift out rails 32 between a recessed position beneath the work surface 14 of the truss assembly table 12, as shown in FIG. 2, and a raised position above the work surface 14 of the truss assembly table 12 and that may be inclined relative to a horizontal plane as shown in FIG. 3. After a truss 29 is assembled on the work surface 14 of the truss assembly table 12, the lift out rails 32 are raised to lift the assembled truss 29 above the jig stops 24 and such that the assembled truss 29 slides down the lift out rails 32. The incline can be of sufficient angle to cause the truss assembly 29 to slide down the lift out rails due to gravity alone. Alternately, the slope may be sufficient to ease the process of pushing or pulling the truss 29 along the lift out rails.

Each lift out rail translating assembly 34 for moving one of the lift out rails 32 preferably includes a first arm 42 pivotally connected at a first pivot mount 44 on the lift out rail 32 defining a pivot point on the lift out rail 32; a second arm 46 pivotally connected at a second pivot mount 48 on the lift out rail 32 defining a second pivot point on the lift out rail 32 that is spaced-apart from the first pivot point; and an actuator 50 operatively connected to move the lift out rail 32 between the recessed position and the raised position. The first arm 42 and the second arm 46 are pivotally connected to the frame 52 of the truss assembly table 12 at pivot mounts 54 and 56, respectively, below the work surface 14. As shown in FIGS. 2 and 3, the first arm 42 and the second arm 46 are pivotally connected to the frame 50 of the truss assembly table 12 at pivot points defining a line substantially parallel to the work surface of the truss assembly table 14, and wherein the first arm 42 and the second arm 46 are of substantially different lengths.

The actuator 50 is preferably a piston-cylinder 58 operatively connected to the first arm 42 or the second arm 46. For example, as shown in the drawing, the piston-cylinder 58 is pivotally connected at one end thereof to pivot mount 60 on the frame 52 and the other end thereof to pivotal connection 62 of the extension arm 64, which is in turn rigidly connected to the first arm 42 as an extension of the first arm 42 from adjacent the pivot mount 56. This actuator 50 provides the driving force to move the lift out rail 32 and the assembled truss 29 to an inclined or sloped position as shown in FIG. 3.

It is to be understood that the details of the rail lift out assembly are not critical to the invention and may be of any workable design known in the art. Actuators for the system may be of any known type including hydraulic, pneumatic and electric. In an alternate embodiment, multiple actuating cylinders are used to raise the lift out assemblies to the raised position. Further, it is possible to raise the lift out arms only to a horizontal position. In such a case, obviously, the truss 29 must be pushed or pulled along the lift out rails. Generally, lift out systems are commercially available from companies such as Alpine Engineered Products, Inc.

Figure 4:
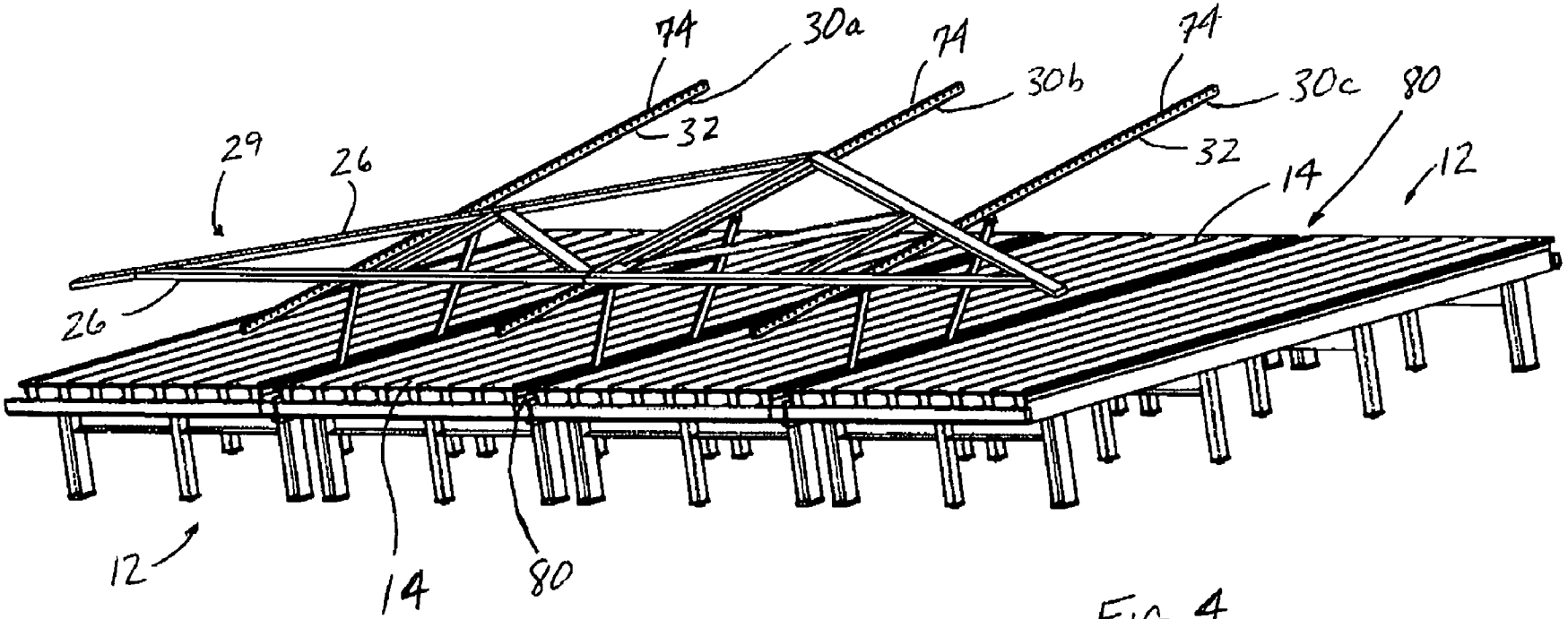
FIG. 4 is an orthogonal view of the truss assembly table with the lift out assemblies in a raised and sloped position.
Figure 5:
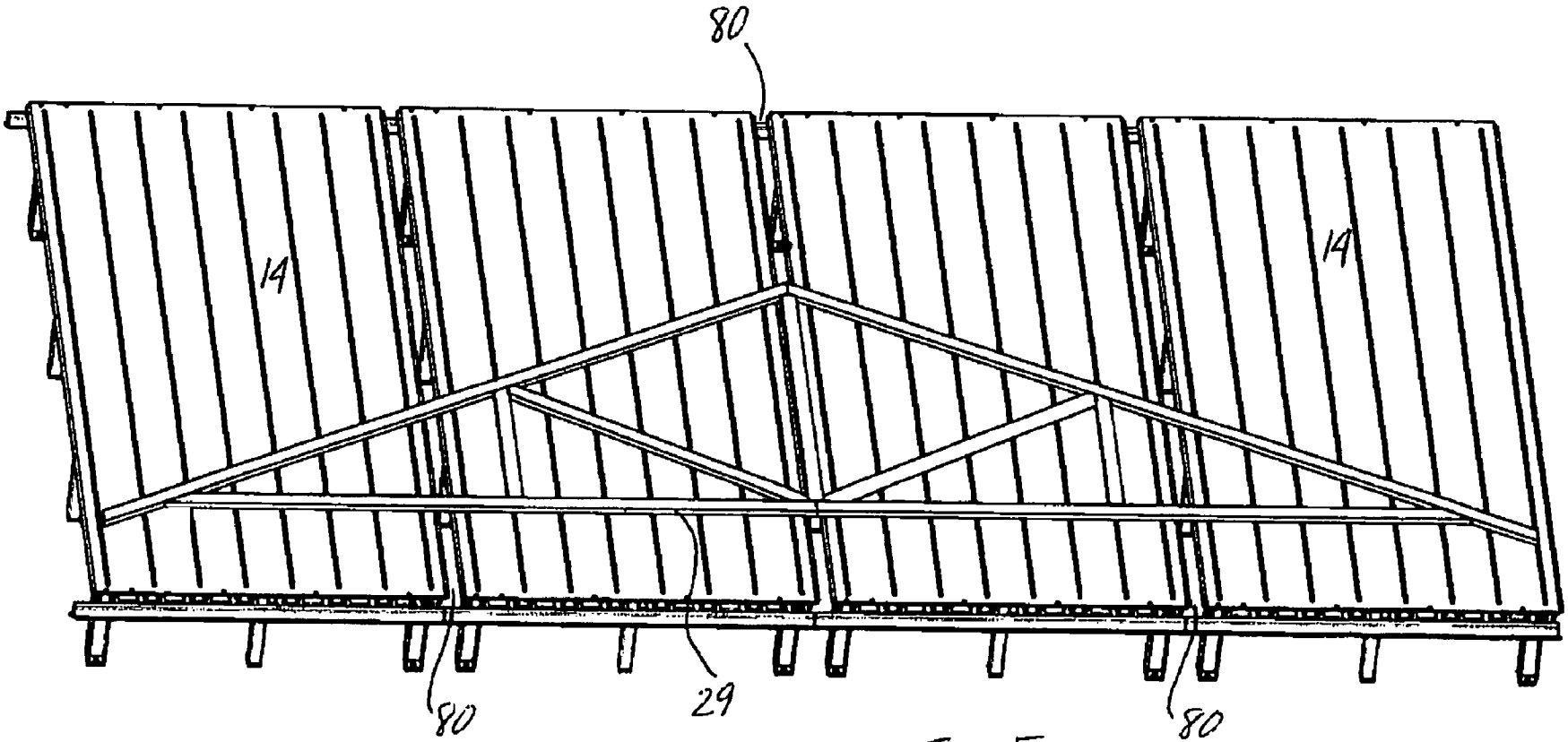
FIG. 5 is an orthogonal view of the truss assembly table with a truss assembly on the work surface and without the lift out assemblies shown.

FIG. 4 presents an orthogonal view of a truss assembly apparatus with each of the lift out assemblies 30*a–c* in a raised and inclined position. Lift out assembly gaps 80 may be clearly seen. The lift out assembly rails 32 are provided with a plurality of skate rollers 74 or wheels to ease movement of the truss assembly along the rails. FIG. 5 presents a similar orthogonal top view with a truss assembly 29 on the table surface 14. The lift out assemblies 30 are removed to accentuate the gaps 80 in the table surface 14. During assembly of the truss, as the gantry press rolls across the work surface, the lift out assembly rails 32 are in a recessed position below the work surface 14. The rails or wheels mounted thereon are not flush with the work surface 14. The rollers may become damaged if used as a work surface for embedding connector plates.

Figure 6:
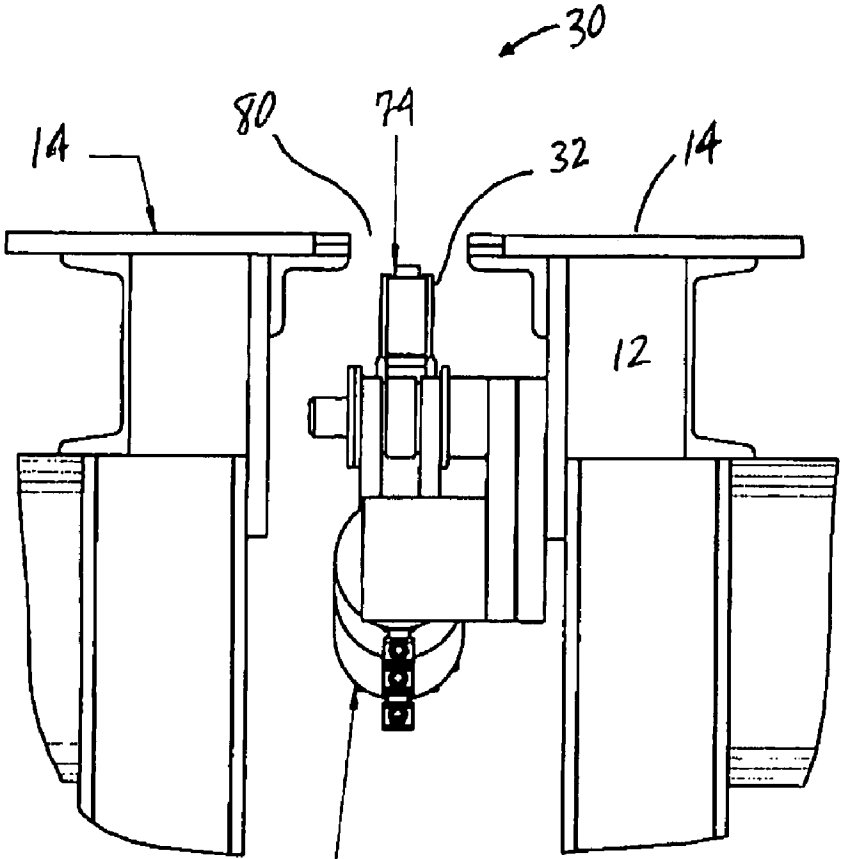
FIG. 6 is a partial elevational side view of a lift out assembly with rollers.

FIG. 6 is an elevational view of the conventional lift out assembly 30 with rail 32 mounted with a plurality of wheels 74. The gap 80 breaks the work surface 14. The width of the gap 80 is conventionally around three inches wide and is necessitated by the width of various elements of the lift out assembly which must pass through the gap when the lift out is moved to its raised position. The skate wheels 74 are positioned below the work surface 14 when the lift out assembly is in the recessed position.

Figure 7:
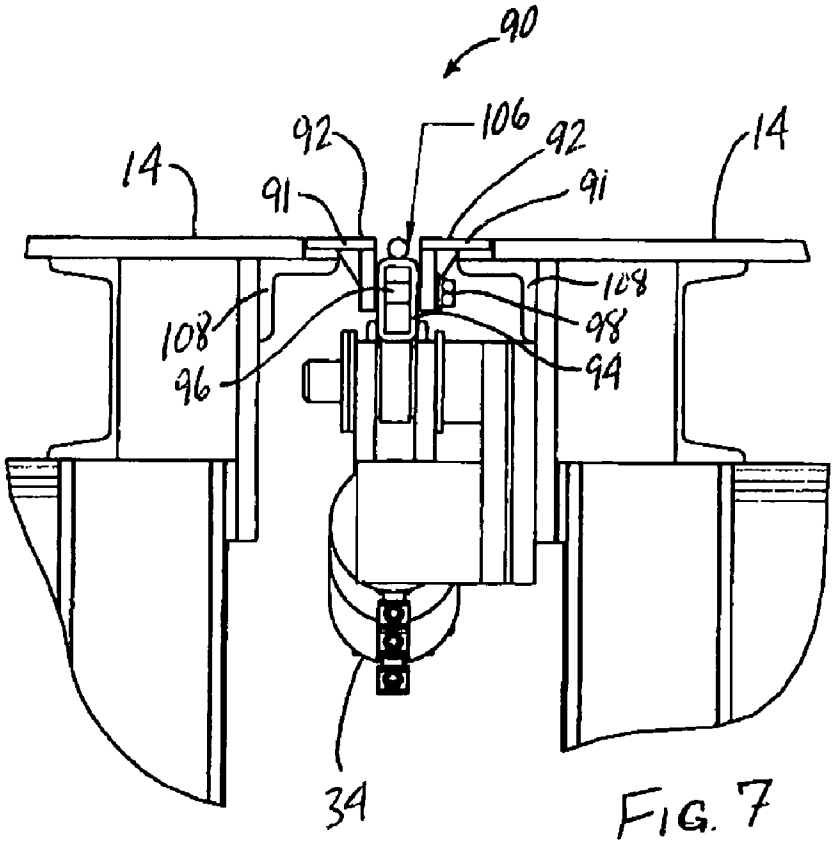
FIG. 7 is a partial elevational side view of a lift out assembly having a support element assembly and slide rod, the lift out rail in the recessed position.

FIG. 7 is an elevational view of the inventive lift out assembly. The gap 80 has been greatly reduced by the introduction of a support surface element assembly 90. The support element assembly 90 has two support elements 91, each of which defines a support surface 92. The support element assembly can have one or more support surfaces 92. In the preferred embodiment, the assembly 90 has two L-shaped support members 91, one on each side of the lift out channel 94. The support elements 91 may have bracing as needed. The support element assembly 90 also includes a pin 96 connecting the assembly 90 to the lift out rail 30, in this case channel 94. The support assembly pin 96 is maintained in position through an elongated slot 100 in the channel 94 by a nut 98. The support surfaces 92 are flush with the truss assembly table work surface 14 when the lift out rail is in the recessed position and provide support for the truss assembly during pressing by the gantry press. The two support surfaces 92 act alone or in conjunction to greatly reduce the width and possible negative effects of the lift out assembly slot 80.

Figure 8:
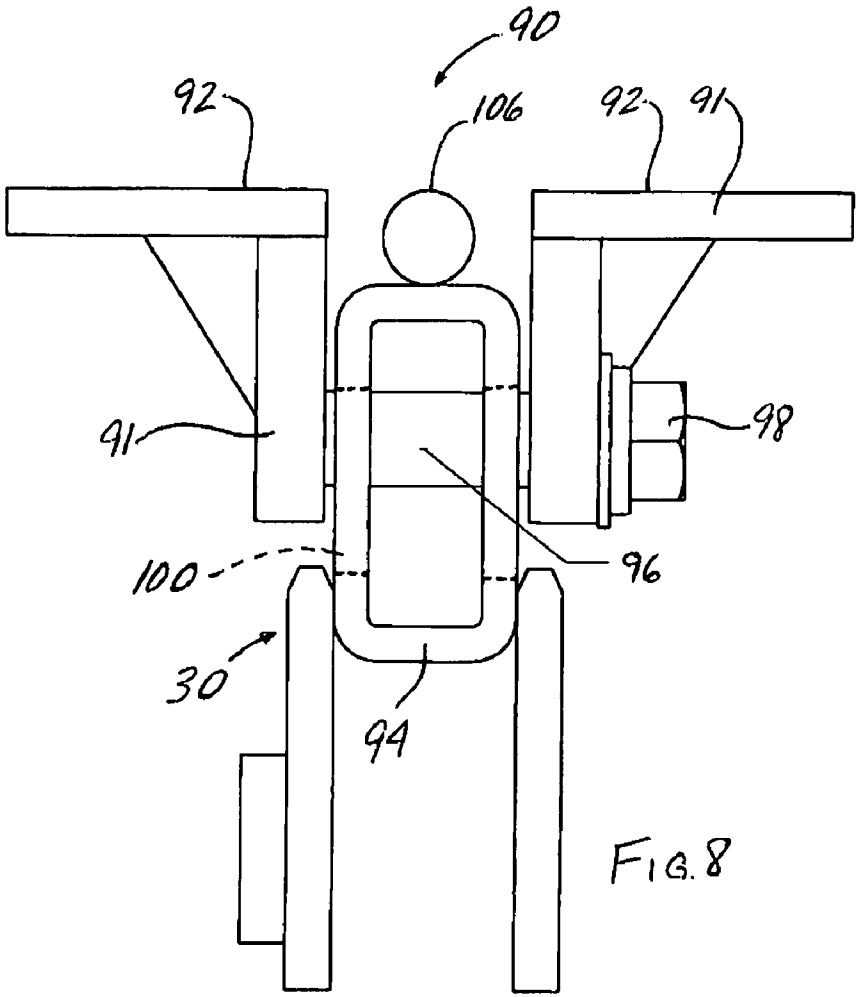
FIG. 8 is a detail of the support element assembly mounted on the lift out rail and in an up position.

FIG. 7 also shows a slide rod 106 mounted to the upper surface of the lift out rail channel 94. The slide rod 106 is designed to allow an assembled truss to easily slide along it when the lift out rail is in the raised position. When the rail is in the raised position, the truss assembly is supported solely by the slide rods 106 on each lift out rail 30. The slide rod 106 is preferably of a non-corrosive material, such as stainless steel, brass or is chrome plated, such that it is resistant to corrosion. Corrosion of the rod would increase friction between the rod and the truss assembly making movement of the truss assembly along the rod more difficult. Since the rod will be exposed to connector plates moving along its length, the rod is preferably made of a hard material, such as stainless steel, so that the connector plates do not gouge the rod surface. It is to be understood that the slide rod may be cylindrical, as shown, or another shape presenting a limited surface for contacting a truss assembly. The cylindrical shape of the illustrated rod presents a surface area of only a line, in theory, for contact with a truss assembly. Similarly, a triangular rod would present such a limited sliding surface. The slide rod is preferably designed to present its sliding surface flush with the truss assembly table work surface 14 when the lift out rail is in the recessed position, as shown in FIGS. 7 and 8. This provides further support for the truss assembly as the gantry press moves across the truss and further acts to reduce the width and possible negative effects of the lift out slot 80.

Rollers 74 can be used in conjunction with the support element assembly 90 instead of the slide rod 106. The upper surfaces of the wheels can be positioned to be flush with the work surface 14 when the lift out rail is in the recessed position. However, as explained herein, the rollers are typically too fragile to provide a supportive function for the truss assembly during the pressing process. Therefore, if the rollers are used in conjunction with the support assembly 90, the rollers are preferably arranged to be beneath the work surface 14 when the lift out rail is in the recessed position.

Figure 9:
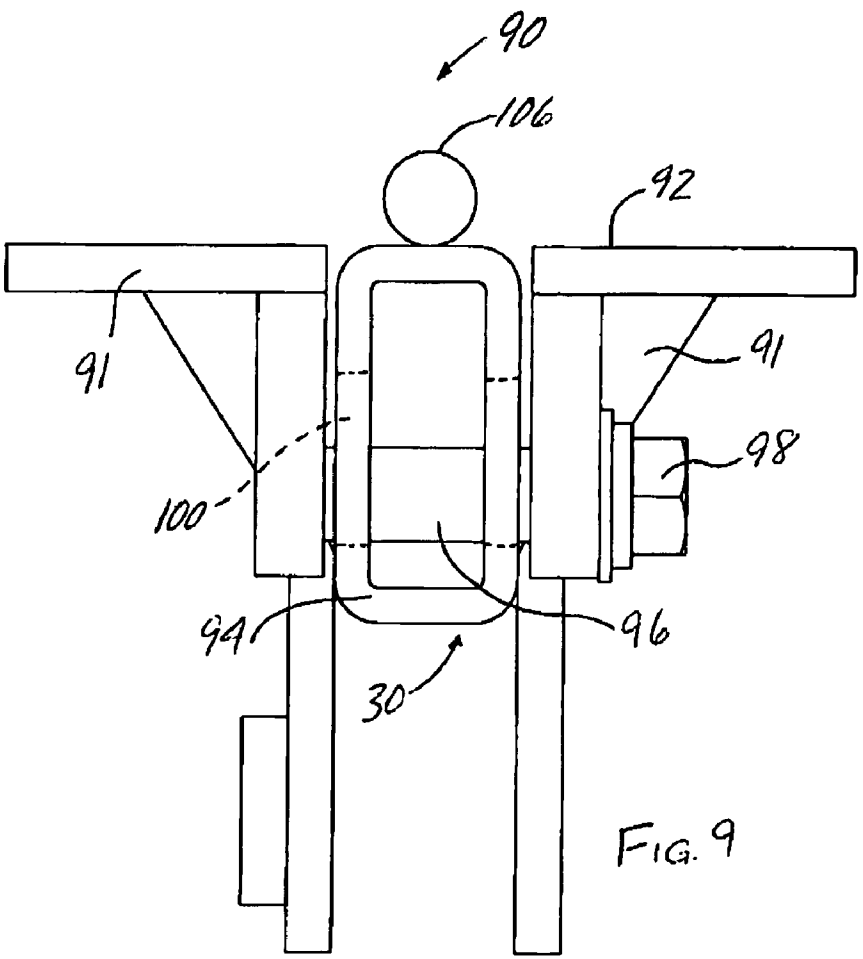
FIG. 9 is similar to FIG. 8 but the support element assembly is in a down position.

The support element assembly 90 is movable between an up position, as seen in FIGS. 7 and 8, and a down position, as seen in FIG. 9. The use of the terms "up" and "down" is not meant to be limiting but merely to imply that the support assembly moves between two positions. In the up position, the support surfaces 92 are flush with the table work surface 14. In a preferred embodiment, they are also flush with the upper surface of the slide rod 106. The support assembly 90 is movable along an elongated slot 100, indicated by the dashed lines in FIGS. 8 and 9, which has been cut in the channel 94. Other methods may be used to allow movement of the support element assembly 90 than the pin and slot design shown here.

When the lift out rail is in the raised position, the support element assembly 90 moves to its down position, as shown in FIG. 9, by force of its own weight. As the lift out rail 30, illustrated as channel 94 in FIGS. 7–9, is lowered to the recessed position, the support element assembly 90 contacts stops 108 and is forced upwards to its up position, as shown in FIGS. 7 and 9. The stops 108 are shown as simple brackets attached to the bottom of the truss table top. The stops can be welded on or attached in any other suitable manner. The stops can be located at any point along the length of the support element assembly and can be configured to abut any member of the support element assembly. The shape and exact location of the stops is not critical as long as they effectively act to abut the support element assembly and move the assembly to the up position as the lift out rail is lowered past the table work surface.

The elongated slot 108 is selected to be of such a length and at such a location as to allow movement of the support element surfaces 92 from an up position where the support surface or surfaces 92 are flush with the work surface 14, to a down position where the support surfaces 92 do not interfere with movement of a truss assembly sliding along the upper surface of the slide rod 106.

Figure 10:
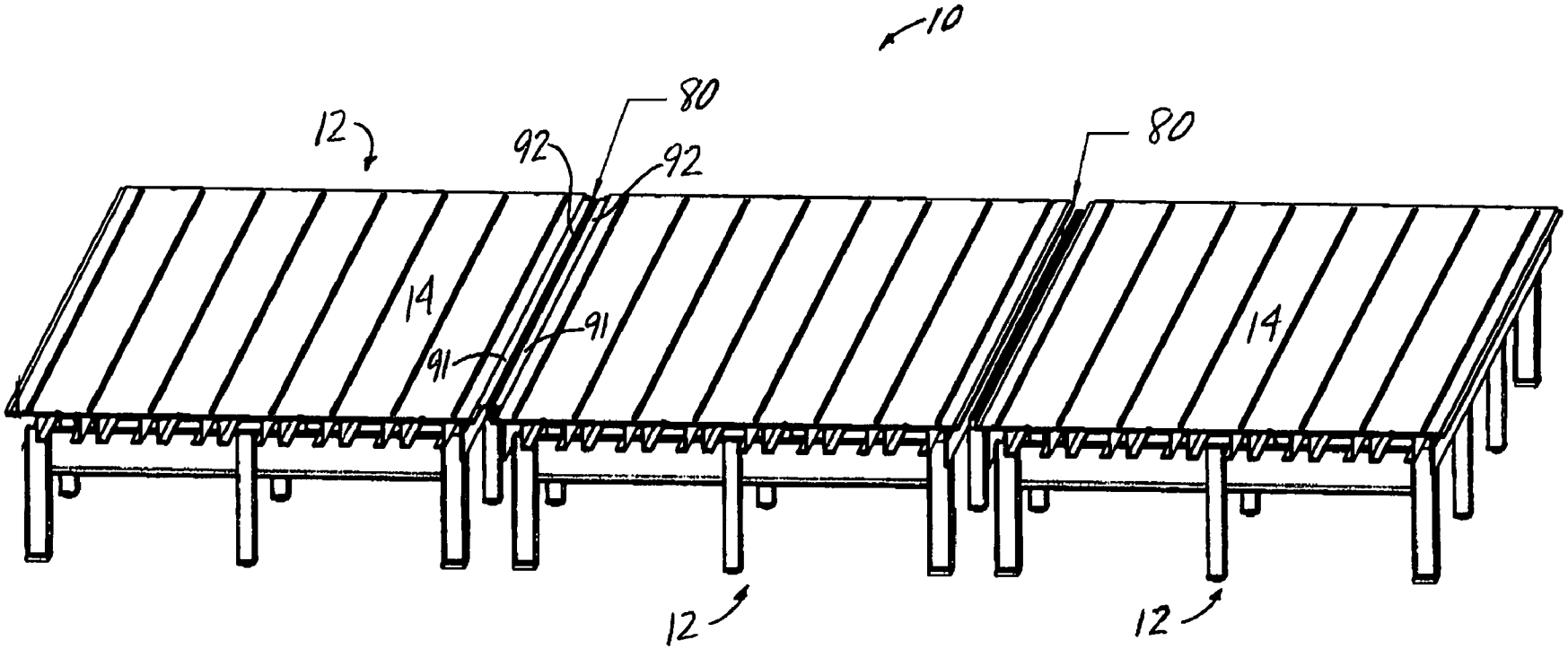
FIG. 10 is an orthogonal view showing a comparison between a lift out assembly gap with and without a support element assembly.

FIG. 10 shows a truss assembly table 10 with two lift out assembly gaps or slots 80 and the lift out assemblies removed. The right slot 80 is shown as a wide gap, not bridged or narrowed by a support element assembly. The slot on the left is shown for contrast, having the support elements 91 in place with support surfaces 92 flush with the table work surface 14. The support surfaces 92 substantially narrow the gap 80.

The embodiments shown and described above are only exemplary. Many details are often found in the art and are currently on the market and available to those in the trade. Therefore, many such details are neither shown nor described. Thus, it is not claimed that all of the details, parts, elements, or steps described and shown are invented herein. Even though numerous characteristics and advantages of the present inventions have been set forth in the foregoing description, together with the details of the structure and function of the invention, the disclosure is illustrative only, and various changes, substitutions and alterations can be made herein without departing from the spirit and scope of the invention as defined by the appended claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An apparatus for use in lifting a truss assembly from a truss assembly table, the apparatus comprising:

a truss table having a work surface;

a plurality of lift out rails movable with respect to the table work surface between a recessed position beneath the work surface and a raised position above the work surface;

a slide mechanism mounted on each lift out rail;

a support element assembly mounted to each lift out rail and movable with respect to the lift out rail;

the support element assembly having a support element defining a support surface;

the support element assembly movable between an up position, wherein the support surface is flush with the work surface of the truss table, the support element assembly in the up position when the lift out rail is in the recessed position, and a down position, wherein the support surface does not interfere with a truss assembly sliding on the slide mechanism of the lift out rail, the support element assembly in the down position when the lift out rail is in the raised position.

2. An apparatus as in claim 1 wherein the lift out rails are inclined when in the raised position.

3. An apparatus as in claim 2 wherein the lift out rails are inclined when in the raised position sufficiently to cause a truss on the rails to slide down due to gravity alone.

4. An apparatus as in claim 1 wherein the lift out rails are channel members.

5. An apparatus as in claim 1 wherein the slide mechanism on each lift out rail defines an upper surface and wherein the upper surface of the slide mechanism is flush with the table work surface when the lift out rail is in the recessed position.

6. An apparatus as in claim 1 wherein the slide mechanism is a slide rod.

7. An apparatus as in claim 6 wherein the slide rod is non-corrosive.

8. An apparatus as in claim 7 wherein the slide rod is at least partially chrome.

9. An apparatus as in claim 7 wherein the slide rod is stainless steel.

10. An apparatus as in claim 1 wherein the slide mechanism is a plurality of rollers.

11. An apparatus as in claim 5 wherein the slide mechanism is a slide rod.

12. An apparatus as in claim 11 wherein the slide rod is cylindrical.

13. An apparatus as in claim 1 wherein the support element is L-shaped.

14. An apparatus as in claim 1 wherein the support element assembly further comprises a second support element defining a second support surface, the second support surface flush with the work surface when the support element assembly is in the up position and the lift out rail is in the recessed position.

15. An apparatus as in claim 1 wherein the truss table further comprises stops, each stop operable to move a support element assembly into an up position when a lift out rail is moved into the recessed position.

16. An apparatus as in claim 15, the truss table further comprising a table top and wherein the stops are mounted to the bottom surface of the truss table top.

17. An apparatus as in claim 1 wherein each support element assembly further comprises a pin movable in an elongated slot in a lift out rail.

18. An apparatus as in claim 15 wherein each support element assembly further comprises a pin movable in an elongated slot in a lift out rail.

* * * * *